US006155012A

United States Patent [19]

Halbitte

[11] Patent Number: 6,155,012

[45] Date of Patent: Dec. 5, 2000

[54] MIXED-USE BUILDING, FOR EXAMPLE FOR HABITATION AND FOR BUSINESS USE

[75] Inventor: Dominique Halbitte, 29, Rue Professeur Patel, 69009 Lyons, France

[73] Assignee: Dominique Halbitte, Lyon, France

[21] Appl. No.: 09/142,832

[22] PCT Filed: Mar. 4, 1997

[86] PCT No.: PCT/FR97/00381

§ 371 Date: Oct. 30, 1998

§ 102(e) Date: Oct. 30, 1998

[87] PCT Pub. No.: WO97/35082

PCT Pub. Date: Sep. 25, 1997

[30] Foreign Application Priority Data

Mar. 18, 1996 [FR] France ..... 96 03554

[51] Int. Cl.[7] ..... E04H 1/04

[52] U.S. Cl. ..... 52/236.3; 52/169.4; 52/236.4

[58] Field of Search ..... 52/169.3, 169.4, 52/169.9, 236.3, 236.4, 236.5, 236.7, 79.1, 79.2, 79.4, 79.7

[56] References Cited

U.S. PATENT DOCUMENTS

| | | | |
|---|---|---|---|
| 2,241,830 | 5/1941 | Tourtellotte | 52/236.4 X |
| 3,479,781 | 11/1969 | Johnson | 52/236.3 X |
| 3,638,379 | 2/1972 | Williams | 52/236.3 X |
| 3,656,266 | 4/1972 | Tylius | 52/236.4 X |
| 3,750,354 | 8/1973 | Boros | 52/236.4 |
| 4,035,973 | 7/1977 | Sutelan | 52/236.4 X |
| 4,794,747 | 1/1989 | Yendo | 52/236.3 |
| 4,918,889 | 4/1990 | Luntröm et al. | 52/236.4 X |
| 5,694,725 | 12/1997 | Kaufman et al. | 52/236.3 |
| 5,809,704 | 9/1998 | Stewart et al. | 52/169.4 |
| 5,941,034 | 8/1999 | Frankfurt | 52/236.3 |

FOREIGN PATENT DOCUMENTS

| | | | |
|---|---|---|---|
| 6-248744 | 9/1994 | Japan | 52/236.3 |
| WO 82 04458 | 12/1982 | WIPO . | |
| WO 95 06795 | 3/1995 | WIPO . | |

*Primary Examiner*—Richard Chilcot
*Attorney, Agent, or Firm*—Oliff & Berridge, PLC

[57] ABSTRACT

Mixed-use building, for business use and for habitation use, including at least one habitation unit located on a level known as a habitation level, at least one business unit located on another level known as a business level, and at least one internal private passage interconnecting the habitation unit and the business unit. The building also includes an entrance known as a habitation entrance, another entrance known as a business entrance, a habitation passage peculiar to the habitation level that communicates with the habitation entrance, and a business passage peculiar to the business level and separate from and independent of the habitation passage. The habitation unit is served solely by the habitation passage, and the business unit is served solely by the business passage.

5 Claims, 2 Drawing Sheets

MIXED-USE BUILDING, FOR EXAMPLE FOR HABITATION AND FOR BUSINESS USE

BACKGROUND OF THE INVENTION

The present invention relates to the arrangement and the disposition of any building or construction in order to integrate different activities therein in a practical manner, namely business activity and habitation, in particular temporary accommodation.

The present invention will be introduced, defined, explained and discussed, but only by way of an example which does not limit its scope, by reference to a mixed-use building integrating hotel-type and office-type activities.

A mixed-use building for office-type use and for hotel-type use is already known and comprises:

at least one unit arranged as a habitation unit, namely as a hotel room, located on a level known as the habitation level, at least one unit arranged as a business unit, namely as an office, located on another level known as the business level, and at least one internal private passage, in particular with a staircase, extending from the habitation level to the business level and interconnecting the habitation unit and the business unit.

SUMMARY OF THE INVENTION

The object of the present invention is a mixed-use building as described above, arranged and disposed in order to allow coexistence but also independence of the business activities and the habitation activities respectively in the same mixed-use building.

According to the present invention the mixed-use building comprises:

a first entrance and a second entrance which may be grouped together or isolated but are independent of one another.

a first passage which are peculiar to the first level and communicate with the first entrance, a second passage which are peculiar to the second level and are separate from and independent of the first passage means, the first unit being served solely by the first passage as far as its access from the outside is concerned, and the first unit and the second unit being grouped together as a module, with separate first and second accesses from the outside.

According to the invention, the building defined above is used in a mixed manner, that is to say for business use, in particular of the office type, and habitation use, in particular temporary accommodation, for example of the hotel type, according to the following dispositions:

the first unit is arranged as a habitation unit and the first level is for habitation use, the second unit is arranged as a business unit and the second level is for business use, the first entrance is for habitation use and comprises, for example, an entrance hall for a resident, the second entrance is for business use and comprises, for example, an entrance hall for a business visitor, the first passage is for habitation use, the second passage is for business use, and the module is a mixed-purpose module, reserved for a resident for example, with a first, habitation access and a second, business access.

A building as defined above and used according to the invention therefore makes it possible to separate the movement flows which result from the activity of habitation or of temporary accommodation, for example of the hotel type, and the business movement flows, in particular of the office type, and to arrange the corresponding parts of the building in a manner specific to these two activities respectively. A building is thus obtained which has on the one hand or in one part the complete appearance of a building for habitation or for temporary accommodation, for example a hotel, and on the other hand or in another part the appearance of a business building, for example of offices, and moreover without the two corresponding activities overlapping and impeding one another.

BRIEF DESCRIPTION OF THE DRAWINGS

The present invention will now be described by reference to the attached drawing, in which.

DETAILED DESCRIPTION OF THE PREFERRED EMBODIMENTS

Figure 1:
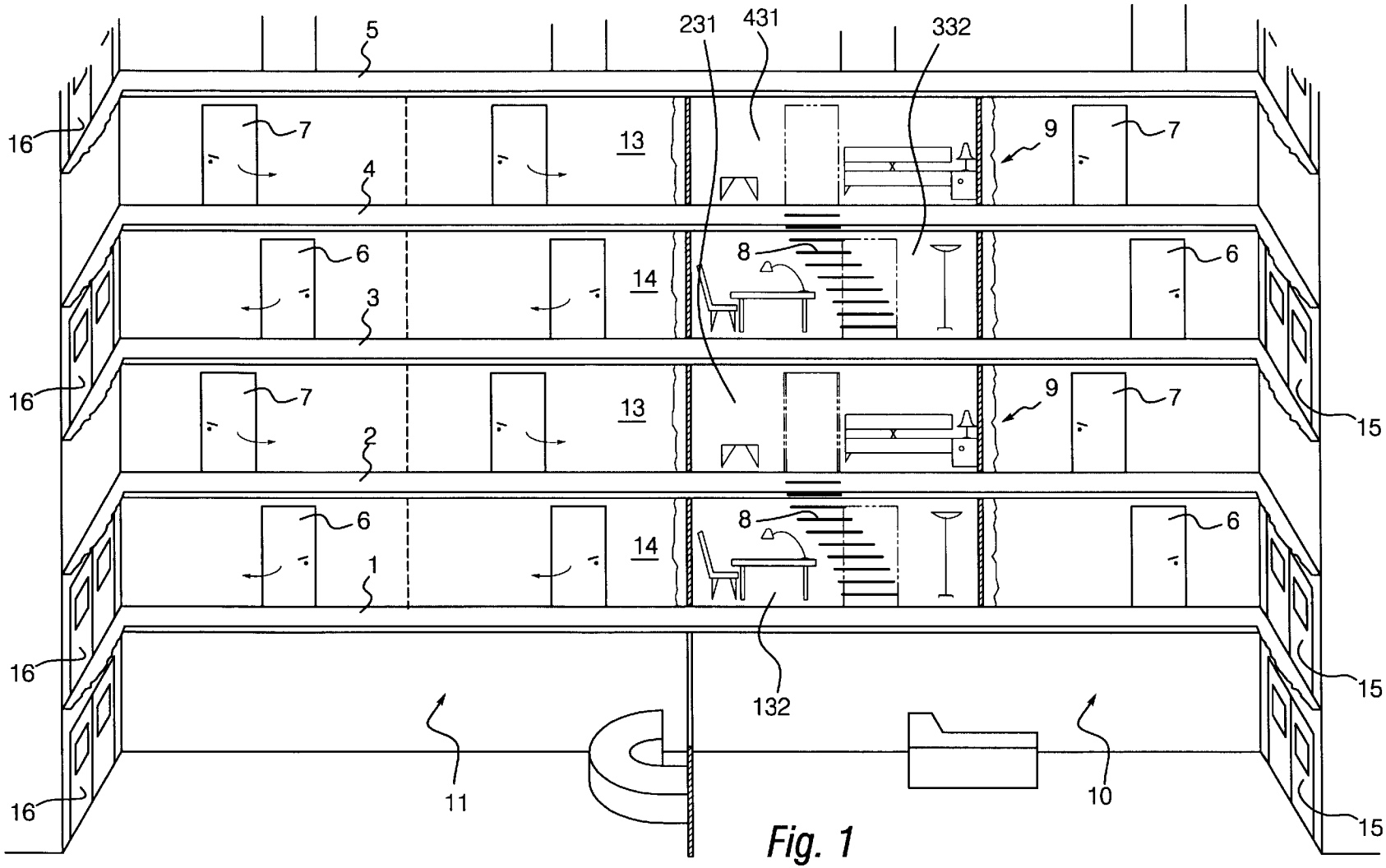
FIG. 1 shows in vertical section a mixed-use building according to the invention, which is simultaneously of the office type and of the hotel type.

A mixed-use building according to the attached drawing has the dual function of hotel and office building. It is arranged and disposed as described below so as to serve this dual function, with completely separate and independent movement flows of people and activities corresponding to these two functions respectively.

To this end, this building comprises in a general manner:

an entrance 10 known as a habitation or temporary accommodation entrance, for example an entrance hall or reception area of the hotel type, for a resident, this entrance being located on the ground floor of the building, another entrance 11 known as the business entrance, for example an entrance hall of the type found in the reception area of an office building, for a business visitor, also located on the ground floor of the building, this business entrance being in this case isolated from and independent of the habitation or temporary accommodation entrance 10, a plurality of levels known as habitation levels, for example 2 and 4, which communicate with the habitation entrance 10 via a passage 13, known as a habitation passage, which are peculiar to the habitation level and comprise, for example, a corridor for passage, an equal plurality of other levels, for example 1 and 3, known as business levels, which communicate with the business entrance 11 via a business passage 14 which are peculiar to the various business levels and separate from and independent of the habitation passage 13, the habitation levels 2, 4 being interposed between the habitation levels 1, 3 in such a manner that a given habitation level, for example 2, is different from the following adjacent business level (in the vertical direction of the building), for example is superposed on it.

On each habitation level, for example on level 1, a number of independent habitation or temporary accommodation units, of the hotel-room type, are disposed and arranged, one of which is illustrated by reference number 231, having a codification according to which the hundred designates the level, the ten the order number of the unit on the level, and the unit the type of unit, namely a habitation unit in this case. For each habitation level, for example 2, all the units are served solely by the habitation passage 13, which are peculiar to this level, as far as their access from the outside is concerned, for example via a landing door or access 7, for the resident.

On each business level, for example on level 1, a plurality of business units is arranged, for example 132, having a codification according to which the hundred designates the level, the ten the order number of the habitation unit on the level, and the unit the type of unit, namely a business unit in this case. For one and the same business level, for example 1, all the business units are served solely by the business passage 14 as far as their access from the outside is concerned, for example via a landing door or access 6, for a business visitor but also, if applicable, for the resident.

As FIG. 1 shows, the number of business units described above is identical to the number of habitation units, and in one and the same cross-section of the building, the habitation units are interposed between the business units in such a manner that a habitation unit, located on a given level, corresponds or is related to a business unit on the level immediately above or below.

Apart from the interposition of a business level between two habitation levels or of a habitation level between two business levels, the alignment, in the vertical direction of the building, of the habitation and business units is by no means obligatory, and any other design may be adopted as far as the relationship between the business and habitation units is concerned. For example, a habitation unit may be offset in relation to a business unit, or otherwise the floor surface area of a business unit may be different, for example greater, than the floor surface area of the habitation unit etc.

Figure 2:
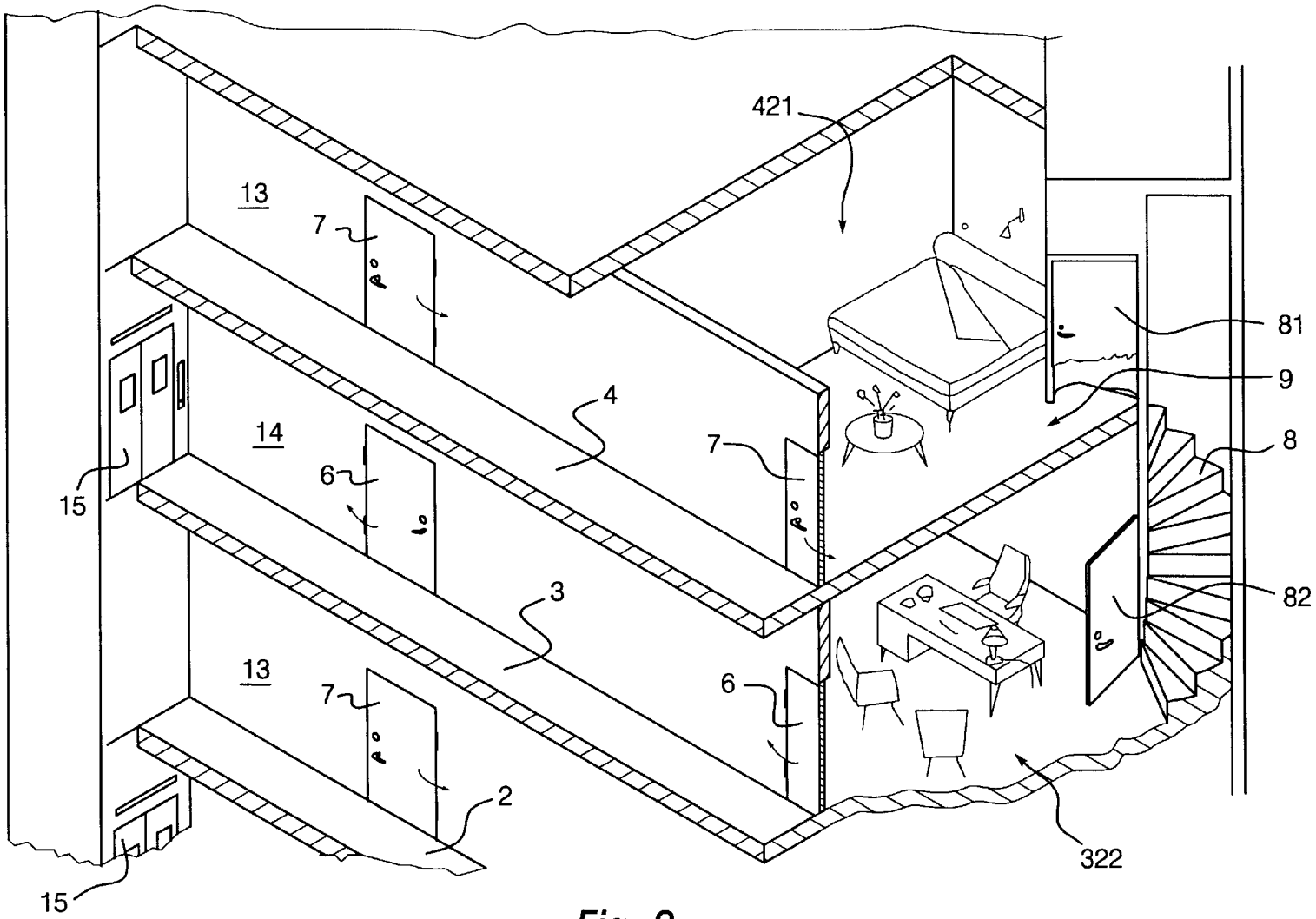
FIG. 2 shows a partial sectional view of the mixed-use building shown in FIG. 1.

As shown in FIG. 2, considering the case of a habitation unit, for example 421, and a business unit, for example 322, immediately following in the vertical direction of the building, for example above or below the habitation unit 421, an internal private passage 8, in particular with a staircase, extends from the habitation level 4 to the business level 3, interconnecting the habitation unit 421 and the business unit 322. This private passage 8 may be closed by two doors 81 and 82, one to isolate it from the habitation unit 421 and the other to isolate it from the business unit 322.

In this manner, the habitation unit 421 and the business unit 322 are thus grouped together as a mixed purpose module 9, reserved entirely and solely for a resident for example, with completely separate accesses from the outside 7 and 6, habitation and business respectively, and moreover without the business activity flow meeting the activity flow resulting from the habitation or temporary accommodation—for example hotel—function of the building.

In short, if the principles of the present invention are generalized, for a building or property comprising x habitation levels and y business levels, x and y being identical or different whole numbers, and n habitation units per habitation level and p business units per business level, which units are interconnected respectively in pairs by n internal private passages, n and p being identical or different whole numbers, the arrangement described above defines n mixed-purpose modules, namely for business and habitation, each connecting two successive habitation and business levels, for n permanent or temporary residents. As described previously, the business and habitation activity flows of the building still remain independent and consequently keep the exercise of a given function separate in relation to the exercise of the other function.

By way of complement and as shown by FIGS. 1 and 2, the habitation passage 13 and the business passage 14 comprise respectively two banks of lifts 15 and 16 which are separate from and independent of one another and serve respectively and separately the habitation levels, for example 2, 4, and the business activity levels, for example 1, 3.

Clearly, when reference is made to the independence or separation either of the habitation and business levels or of the habitation passage 13 and the business passage 14, this means separation or independence, as it were "isolation", in the normal use of the mixed-use building or property, which does not of course preclude the disposition of temporary passages, for example common doors or staircases prescribed for safety reasons, between these different levels or between these different passage means.

Any building according to the invention may comprise other levels which are arranged differently, that is to say without mixed-purpose modules, for example with habitation and/or business units which do not form mixed-purpose modules with each other. Furthermore, on one and the same level of the building, habitation or business units, which are independent of any mixed-purpose modules, may be interposed between habitation or business units which belong to mixed-purpose modules.

What is claimed is:

1. A building comprising:

at least one first unit on a first level;

at least one second unit on a second level;

at least one internal private passage with a staircase extending from the first level to the second level and interconnecting the first unit and the second unit;

a first entrance and a second entrance independent of one another;

a first passage peculiar to the first level that communicates with the first entrance;

a second passage peculiar to the second level that communicates with the second entrance and is separate from and independent of the first passage, wherein the first level and the second level are superposed and the first unit is served solely by the first passage for access from the outside, the second unit is served solely by the second passage for access from the outside, and the first unit and second unit are grouped together as a module with separate first and second accesses from the outside.

2. The building according to claim 1, wherein the first level includes a plurality of first units and the second level includes an equal plurality of second units connected respectively to the first units by an equal plurality of internal private passages so as to define a plurality of modules.

3. The building according to claim 1, further comprising a plurality of first levels and an equal plurality of second levels so as to define at least a plurality of modules each connecting to successive first and second levels.

4. The building according to claim 1, wherein the first passage and the second passage include respective lifts that are separate from and independent of one another and serve respectively and separately each first level and each second level.

5. The building according to claim 1, wherein the first unit is arranged as a habitation unit and the first level is for habitation use, the second unit is arranged as a business unit and the second level is for business use, the first entrance is for habitation use and includes an entrance hall for a resident, the second entrance is for business use and includes an entrance hall for a business visitor, the first passage is for habitation use, the second passage is for business use, and the module is a mixed-purpose module reserved for a resident with a first habitation access and a second business access.

* * * * *